US005150095A

United States Patent [19]

Jones

[11] Patent Number: 5,150,095

[45] Date of Patent: Sep. 22, 1992

[54] MULTI-POSITION ROTARY SWITCH WITH POSITION SENSOR

[75] Inventor: William H. Jones, Villa Park, Ill.

[73] Assignee: Appliance Control Technology, Inc., Addison, Ill.

[21] Appl. No.: 680,523

[22] Filed: Apr. 4, 1991

[51] Int. Cl.[5] ..... H01C 10/10

[52] U.S. Cl. ..... 338/196; 338/191; 338/198; 338/200

[58] Field of Search ..... 338/196, 191, 198, 200, 338/201, 160

[56] References Cited

U.S. PATENT DOCUMENTS 4,410,873 10/1983 Kuratani ..... 338/196 X 4,728,921 3/1988 Andresen et al. ..... 338/196

*Primary Examiner*—Marvin M. Lateef

*Attorney, Agent, or Firm*—Robert J. Black

[57] ABSTRACT

A rotary switch for controlling electrical circuitry in ranges, ovens, etc., to be manually adjusted for control of function cycles. Included with the manually operated function selector are means for determining the position of the function selector providing at the same time via a low voltage DC communication link, with a solid state microprocessor or similar unit as used for control of ranges, ovens, etc.

7 Claims, 1 Drawing Sheet

MULTI-POSITION ROTARY SWITCH WITH POSITION SENSOR

BACKGROUND OF THE INVENTION

1. Field of the Invention

The present invention relates to rotary switches utilized for the selection of different modes of operation in ranges, ovens, etc. Particularly it pertains to a method of determining on a low voltage basis the position of the switching mechanism.

2. Background Art

Electric ranges and similar devices typically have control devices for the apparatus which allow the operator to select the mode in which the device is to be used. For example, in an oven, seven positions of the rotary selector switch might include off, convection baking, baking, cleaning, conventional cooking, broiling and convection broiling. In the usual arrangement, a rotary switch provides the necessary selection. Control effected by such a rotary switch provides the necessary electro-mechanical controls which operate on 120 VAC and 240 VAC. In today's technology where microcomputers and similar units are utilized for control, low voltage DC is typically used for control information. Accordingly, it is quite desirable to provide a low voltage indication of the position (or selection) to which the rotary switch has been operated to provide an indication to the control equipment of that position and the function to be controlled.

Devices which have been utilized for this particular purpose which might be applied included such as those disclosed in U.S. Pat. No. 4,580,138 which disclose a measurement expressing apparatus including a plurality of electrical switches with a separate different resistance associated for each step with the resistances being binary related value to each other. The resultant analog to digital output is in N-bit binary weighted form. A potentiometer having a switching function which might be employed in a similar environment is taught by U.S. Pat. No. 4,647,897. It utilizes a three wire potentiometer with an on-off switch at one end with three wires running on three concentric tracks.

Yet another approach is taught in U.S. Pat. No. 4,740,672 which provides a binary output signal with a dual output. when rotated, the unit disclosed generates a first and second pulse train. Another oven controller which attacks some of the same problems provides several independent switches without resistors is shown in U.S. Pat. No. 4,849,597. The arrangement thus provides a digital output rather than analog as taught by the present invention. Each switch accordingly requires its own wire lead and provides a binary coded device.

As electronic controls interface with electro-mechanical controls a method of communicating between the two controls is required. Since electro-mechanical controls typically operate on 120 VAC and electronic controls use a low voltage DC, a communication link involves isolating the voltages and reducing the AC voltage to a DC equivalent voltage. This typically requires many components and is very expensive. None of the elements as known in the prior art as described above provide a simple economical means for dealing with that particular problem. Accordingly, it is the object of the present invention to provide a new and economical efficient method of determining the position of a rotary switch on a two wire low voltage basis.

SUMMARY OF THE INVENTION

The present invention utilizes a ceramic substrate with resistance as an extra layer on an electro-mechanical switch assembly so that when the switch shaft is rotated the resistance on the substrate will change to indicate the position of the shaft. Typically speaking, such switches usually may have up to seven discrete positions. Selection then chosen by the user must be compatible with options selected by the timer to execute. The ceramic substrate of the present unit utilizes two lines to communicate that resistance reading to a solid state microprocessor timer in response to the position of the shaft. The resistance between these two terminals provides an output that can then be decoded by the microprocessor timer to determine and act upon the position of the shaft. The present invention can be developed to work with devices that are used for user input, or for a mechanical timer that determines what loads to turn on or a device that incorporates both such functions.

The primary feature of the present invention is the utilization of a compact variable resistance element which may built into the base of the selector swith housing. In the arrangement utilized, a contact wiper keyed into the base of the rotary cam portion of the switch provides contact to a ceramic substrate. As noted previously, only two leads are required in the present invention to identify the position of the selector switch. These positions each will then provide a different resistance value associated with each position. A very simple series circuit is employed. By utilizing a ceramic substrate with a fired on resistor, the extremely high ambient temperatures encountered in ranges, ovens, etc., provide a resistor that is capable of functioning in ambients of up to 105 degrees centigrade. Thus, the ceramic substrate provided meets such temperature extremes.

The present invention provides a low cost method to sense the position of electro-mechanical switches utilizing a microprocessor timer without the need for voltage isolation or voltage level conversion. It does this by improving upon the present electro-mechanical switch rather than adding a second switch or adding interface circuitry. Thus, it provides both lower cost and more reliability.

DESCRIPTION OF THE PREFERRED EMBODIMENT

Figure 1:
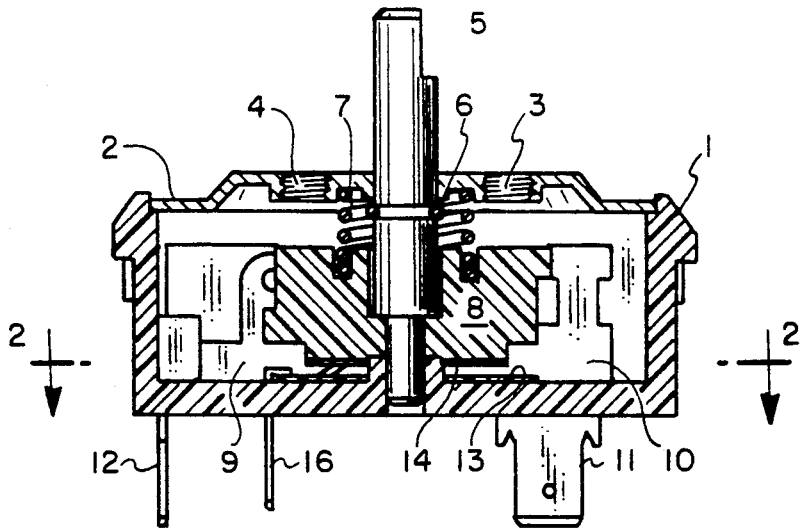
FIG. 1 is a cross-section of a rotary switch employing position sensor apparatus in accordance with the present invention.

Referring now to FIG. 1, a cross-sectional drawing of the multi-position switch incorporating a position sensor arrangement in accordance with the present invention is shown. The unit includes a phenolic housing 1, a steel cover 2, which incorporates threaded mounting holes 3 and 4. Running through the center of the switch is a brass shaft 5 retained in place by C ring 6 to retain the entire assembly in position. By means of stainless steel spring 7, the cam 8 is biased against the rear wall of housing 1. Positioning the cam against the rear wall insures wiper 14 fingers will have adequate contact force on the substrate conductive pads 21 through 28. The multi-position switch, the details of which do not form a portion of the present invention, consists of a phenolic cam portion 8 and brass switch blades such as 9 and 10. Also associated with the brass switch blades are terminals such as 11 and 12. It should be noted that the number of terminals and switch blades is determined by the number of positions in the switch. For example, in the present embodiment shown, seven positions would probably be included. The remaining switch contacts and terminals have not been shown inasmuch as they do not form a detailed important portion of present invention.

Figure 2:
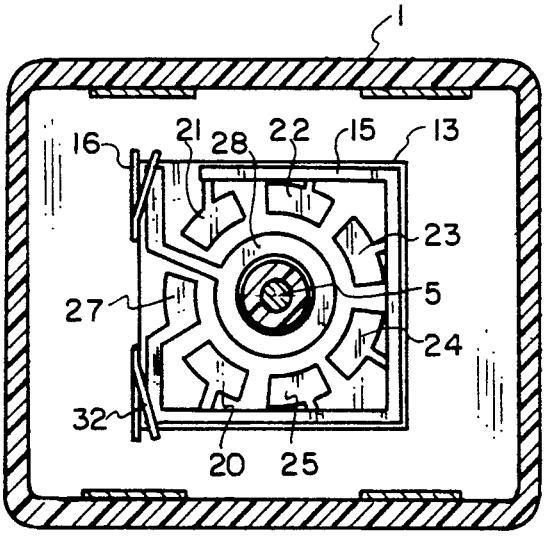
FIG. 2 is a cross-section of the rotary switch of the present invention taken along lines 2—2 of FIG. 1.

Again referring to FIG. 1, substrate 13 shown include a resistive element and contact pads. Wipers 14 which are typically manufactured of beryllium copper are located on the bottom of the phenolic cam portion of the switch and make contact with the pads located on the ceramic substrate. Terminals, such as 16, as seen in FIG. 1, provide electrical connections to the substrate. A better understanding of the ceramic substrate, including resistance, contacts which provide position sensing of the switch contacts in the present unit, may be had by referring to FIG. 2 which is a sectional view taken along lines 2—2 of FIG. 1. Here the housing 1 of phenolic is shown providing support for substrate 13. Included on the substrate is resistive element 15, a resistive ink printed on ceramic and then fired. A ceramic base is utilized because of extremely high ambient temperatures typically encountered in ranges and similar devices in which the particular unit of the present invention would be utilized. Accordingly, the resistors must be capable of functioning in ambient temperatures of at least 105 degrees centigrade. The proposed ceramic substrate and arrangement typically utilized will meet these temperature extremes.

Figure 3:
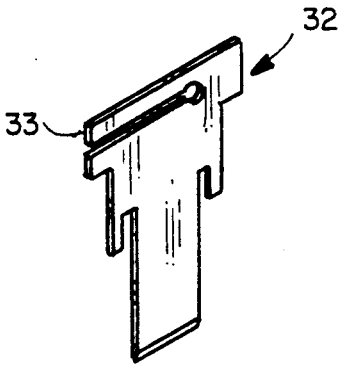
FIG. 3 is a perspective view of a terminal for connection to the position sensing portion of the rotary switch of the present invention.
Figure 4:
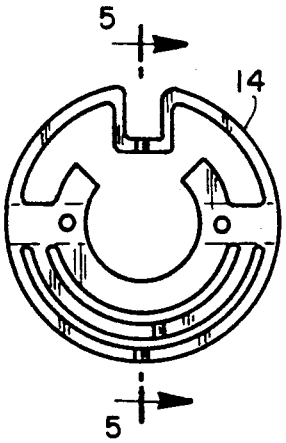
FIG. 4 is a wiper mechanism for use in making contact with the portion of the position sensor apparatus in accordance with the present invention.
Figure 5:
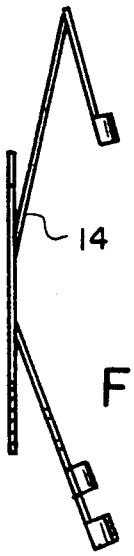
FIG. 5 is a enlarged cross-sectional view of a wiper for use in the position sensor apparatus in accordance with the present invention.

Terminals or pads 21 through 27 are of silver ink printed on the ceramic substrate and also fired. In addition, the center area being the input connection to the substrate portion 28 is also of silver ink fired on the ceramic. It can be seen that brass terminals 16 and 32 provide the necessary low voltage connections to the ceramic subtrate. Details of the substrate sensor terminals are shown in FIG. 3. In practice, the upper portion 33 is bent over to make contact with the input and output leads to the ceramic substrate and soldered thereto for dependable electrical connection. Details of the wiper 14 which provides the necessary contact between the input of the sensor and the various pads associated with portions of 21 through 27 associated with resistor 15 as shown in FIG. 4. Wiper 14 is pinned into the base of the rotary cam member 8. A cross section wiper 14 is shown in FIG. 5. As may be seen, the spring portions provide the necessary contact with the ceramic substrate as the switch is rotated.

From the foregoing, it can be seen that in operation only the two leads connected to terminals 12 and 32 are required for the position sensor to identify the position of the selector switch. Each position obviously has a different resistance value represented by the terminals 21 through 27 all attached to resistor 15. Obviously, a simple series circuit is all that is employed. As the switch is rotated from contacts from 21 through 27, each pad respresentative of each of the seven positions represents a different value of resistance which may be then interpreted on a low voltage basis by an associated microcomputer or similar circuitry which operates on a low voltage DC basis.

While but a single embodiment of the present invention has been shown, it will be obvious to those skilled in the art that numerous modifications can be made without departing from the spirit of the present invention which shall be limited only by the scope the scope of the claims appended hereto.

What is claimed is:

1. A multi-position rotary switch including a plurality of switching elements and a manually rotatable mechanism causing operation of a different one of said plurality of switch elements in response to each position of rotation of said mechanism, the improvement comprising:

sensing means operable to provide an indication to an external control circuit of the position to which said mechanism has been rotated and of the switch contact operated in response to said rotation, said sensing means comprising;

a single resistive element including a first circuit termination;

a plurality of circuit pads connected in spaced apart relationship to said resistive element;

a second circuit termination;

and wiper means secured to said mechanism providing in response to said rotation electrical contact between said second terminal and a single one said circuit pads whereby a predetermined amount of resisitance is provided between said first and second terminals and in response to additional rotation of said mechanism a different value of resistance is provided for each position of rotation, said resistance value operated to provide an indication to a connected external control circuit of said position to which said mechanism has been rotated and of switching contact operated in response to said rotation.

2. A multi-position rotary switch as claimed in claim 1 wherein:

said single resistive element is fired onto a ceramic subtrate.

3. A multi-position rotary switch as claimed in claim 2 wherein:

said circuit pads connected to said single resistive element are fired onto said ceramic substrate.

4. A multi-position rotary switch as claimed in claim 3 wherein:

there is further included a common contact also fired to said ceramic substrate.

5. A multi-position rotary switch as claimed in claim 4 wherein:

there is further including a first terminal connected to said single resistive element, a second terminal connected to said common element.

6. A multi-position rotary switch as claimed in claim 1 wherein:

said wiper means includes first, second and third contacts adapted to provide connection between said common terminal and said single resistive element on a selective basis.

7. A multi-position rotary switch as claimed in claim 1 wherein:

said first and second terminals each include a flexible upper portion adapted for connection to said resistive element and said common element, respectively.

* * * * *